US010294728B2

(12) United States Patent
McCarthy et al.

(10) Patent No.: US 10,294,728 B2
(45) Date of Patent: May 21, 2019

(54) DOWNHOLE UNDER-REAMER AND ASSOCIATED METHODS

(71) Applicant: NOV Downhole Eurasia Limited, Stonehouse, Gloucestershire (GB)

(72) Inventors: Brian Andrew McCarthy, Houston, TX (US); Philip Graham Rodger, Angus (GB)

(73) Assignee: NOV Downhole Eurasia Limited, Stonehouse (GB)

( * ) Notice: Subject to any disclaimer, the term of this patent is extended or adjusted under 35 U.S.C. 154(b) by 0 days.

(21) Appl. No.: 15/916,694

(22) Filed: Mar. 9, 2018

(65) Prior Publication Data

US 2018/0195349 A1 Jul. 12, 2018

Related U.S. Application Data

(63) Continuation of application No. 14/752,274, filed on Jun. 26, 2015, now Pat. No. 9,945,184.

(30) Foreign Application Priority Data

Jun. 26, 2014 (GB) ..... 1411412.8

(51) Int. Cl.
*E21B 10/32* (2006.01)
*E21B 7/28* (2006.01)

(52) U.S. Cl.
CPC ..... *E21B 10/322* (2013.01)

(58) Field of Classification Search
CPC ..... E21B 10/26; E21B 10/32; E21B 10/322; E21B 10/325; E21B 7/28
USPC ..... 175/267, 268, 273, 279, 286, 291
See application file for complete search history.

(56) References Cited

U.S. PATENT DOCUMENTS 3,575,245 A * 4/1971 Cordary ..... E21B 10/345 175/268
5,368,114 A * 11/1994 Tandberg ..... E21B 10/322 175/267
6,189,631 B1 * 2/2001 Sheshtawy ..... E21B 10/32 175/284
7,900,717 B2 * 3/2011 Radford ..... E21B 10/322 175/269
8,936,110 B2 * 1/2015 Adam ..... E21B 41/00 175/57
9,945,184 B2 * 4/2018 McCarthy ..... E21B 10/322
2015/0354306 A1 * 12/2015 Fuller ..... E21B 29/005 166/285

* cited by examiner

*Primary Examiner* — Kenneth L Thompson
(74) *Attorney, Agent, or Firm* — Conley Rose, P.C.

(57) ABSTRACT

A downhole under-reamer for use in reaming a downhole bore. The under-reamer comprises a body and a plurality of cutters mounted on the body. The cutters are mounted on the body so as to be extendable from a retracted position to at least two extended positions. The at least two extended positions comprise reaming positions at respective first and second reaming diameters.

20 Claims, 13 Drawing Sheets

DOWNHOLE UNDER-REAMER AND ASSOCIATED METHODS

CROSS REFERENCE TO RELATED APPLICATIONS

This application is a continuation of U.S. patent application Ser. No. 14/752,274 filed on Jun. 26, 2015, and entitled "Downhole Under-Reamer and Associated Methods", which claims priority to GB Application No. 1411412.8 filed Jun. 26, 2014 and entitled "Downhole Under-Reamer and Associated Methods," both of which are incorporated by reference herein in their entireties for all purposes.

STATEMENT REGARDING FEDERALLY SPONSORED RESEARCH OR DEVELOPMENT

Not applicable.

BACKGROUND

Technical Field

The present invention relates to under-reamers and associated methods of reaming. In particular, but not exclusively, the present invention relates to under-reaming at a plurality of diameters or gauges.

Background of Invention

In downhole operations, such as in the oil and gas industry, underreaming operations are often required to increase or standardise the gauge of bores downhole. The drilled bores are lined with tubing, known as casing or liner, and cement is injected into the annulus between the casing and the surrounding bore wall. Typically, the bore is drilled in sections, and after drilling a section that section is lined with casing. Following cementing of the casing, the next section of bore is drilled. However, as the drill bit utilised to drill the next section must pass through the existing casing, the drill bit will of necessity be of smaller diameter than the drill bit used to drill the previous section. It is often considered desirable to enlarge the bore diameter below a section of casing beyond the drill bit diameter, and this is normally achieved by means of an under-reamer mounted above the drill bit.

Where a section of bore is drilled underneath a section of casing or cement sheath, the drill-bit may have a limited diameter such that the borehole drilled may be of a narrower gauge than the lined or cased section of the newly drilled bore section. Particularly in offshore and deepwater wells, getting the largest casing size possible into the ground is critical to ensure target depth (TD) can be reached with the largest bit size possible, thus maximising production and facilitating access. Under-reaming the pilot bore drilled by a typically-fixed diameter drill bit enables casing sizes to be maximised by providing sufficient open hole clearance to allow the maximum pass through casing size to be selected.

To reach the lower section to be drilled, the drillbit may need to pass through restrictions, including any casing, narrowings or sheaths above the section to be drilled. Reaming or underreaming the newly drilled section may allow the newly drilled bore section to have an increased diameter, possibly up to the same diameter as the upper section of bore. As with the drill bit, the reamer or under-reamer may also need to pass through a restricted diameter such as any upper casing, sheath or liner. Accordingly, reamers are typically tripped-in in a retracted configuration with cutter blocks at a reduced diameter, with the cutters being extended when the reaming operation is to commence below any restrictions. Once reaming is completed, cutters are typically returned to the retracted position and the tool retrieved from the bore.

Examples of under-reamers are described in Applicant's U.S. patent application Ser. No. 13/198,594, published as US2012031673 (A1) and applicant's International patent applications, Publication Nos. WO2007/017651 and WO2010/116152, the contents of each being incorporated herein by reference.

SUMMARY OF DISCLOSURE

According to a first aspect of the present invention there is provided a downhole under-reamer for use in reaming a downhole bore, the under-reamer comprising a body and a plurality of cutters mounted on the body, wherein the cutters are mounted on the body so as to be extendable from a retracted position to at least two extended positions, the at least two extended positions comprising reaming positions at respective first and second reaming diameters.

In at least one embodiment of the present invention, the under-reamer may be capable of reaming at a plurality of different diameters. Accordingly, the under-reamer may be capable of reaming a bore/s to a plurality of gauges.

The cutters may be substantially radially extendable. The cutters may be non-pivotably or non-rotatably extendable. The cutters may be substantially linearly extendable. The cutters may be mounted such that their respective cutting or reaming surfaces project outwardly (relative to a central axis of the body) in the retracted and first and second positions. The cutters or reaming surfaces may project outwards in all positions. The cutters or reaming surfaces may be maintained in substantially the same orientation in the retracted and first and second positions; and optionally all positions therebetween. The cutters may be extendable at substantially the same axial location relative to the body in a first and/or second and/or third configuration(s). The cutters may define a diameter at the same axial location relative to the body in the retracted and first extended and second extended positions.

It will be appreciated that the first and second reaming diameters may each respectively define maximum reaming diameters of the under-reamer in respective configurations. For example the first reaming diameter may comprise a first maximum reaming diameter and the second reaming diameter may comprise a second maximum reaming diameter, the first and second maximum reaming diameters being different for different configurations of the underreamer.

In the retracted position the cutters may be positioned at a diameter that is substantially the same or less than the diameter of the body. Accordingly, with the cutters in the retracted position, the under-reamer's maximum diameter may be defined by the body, such that the under-reamer may pass through passages or restrictions with a diameter determined by the body. In the retracted position, the cutters may be substantially flush with or recessed within the body.

It will be appreciated that it is an outermost point or surface of the cutter that is taken to define the diameter as herein described, noting that the Skilled Person will appreciate that it is the outermost point or surface of the cutter that determines the gauge or diameter of the reamed bore (and/or potentially a maximum diameter for passage of the under-reamer through a restriction).

The body may comprise a through-bore. The through-bore may allow fluid passage through the underreamer with the cutters in the retraced and/or first extended and/or second extended position/s. The under-reamer may permit the passage of fluid therethrough in substantially all configurations, at least selectively. The under-reamer may be configured to allow fluid, such as drilling fluid, to pass therethrough, such as to apparatus downhole of the under-reamer (e.g. a drill-bit, further reamer or the like). The fluid in the through-bore may comprise a well-bore fluid; and/or an injection fluid and/or a drilling fluid, or the like.

The under-reamer may be configured to ream different passages or sections at different diameters.

The under-reamer may be configured to ream multiple passages or sections at similar and/or different diameters. The multiple passages or sections may comprise contiguous and/or discontiguous passages or sections.

Two or more of the multiple passages or sections may be contiguous. For example, two of the passages or sections may be directly connected (e.g. a first section of a bore with a first diameter may transition directly to a second section with a second diameter with no intermediate or intervening section or passage).

Two or more of the multiple passages or sections may be discontiguous. For example, the first section may be remote from the second section and/or the first section may be separated from the second section by an intermediate section. The intermediate section may comprise a diameter different from the first and/or second section/s (prior to and/or subsequent to reaming of the first and/or second section/s). The intermediate section may comprise a smaller diameter than the first and/or second section/s. The intermediate section may comprise a diameter/s substantially the same as the first and/or second section/s.

The first section may comprise a section to be reamed to a first diameter. The first section may comprise a previously-reamed section. The first section may comprise a lined or cased section. The first section may comprise a cement sheath.

The under-reamer may be configured to ream a single passage or section at successive or sequential diameters, such as at a first diameter during a first pass of the under-reamer and at a second diameter during a second pass of the under-reamer.

The cutters may be selectively movable between the retracted position and a first extended position and a second extended position. The first extended position may correspond to the first reaming diameter and the second extended position may correspond to the second reaming diameter.

The cutters may be selectively movable from the retracted position to the first extended position and/or the second extended position. The cutters may be selectively movable from the first and/or second extended position/s to the retracted position. The cutters may be selectively re-extendable from the retracted position to the first and/or second extended position/s. The cutters may be extendable from the first extended position to the second extended position.

The cutters may be retracted during tripping in and/or out of the bore and/or during transit downhole, such as through restrictions and/or through sections not requiring reaming (or already-reamed sections).

The cutters may be retracted in between successive downhole reaming operations. For example, the cutters may be extended from the retracted position to the first extended position for reaming a first section at a first diameter. The cutters may then be retracted for transit of the under-reamer to a second section. The transit of the under-reamer may comprise transit through one or more restrictions. At the second section, the cutters may be re-extended (to the first or a second diameter) for reaming of the second section.

Alternatively, the cutters may remain extended in between successive downhole reaming operations. The cutters may remain extended during transit between reaming locations or sections. The cutters may remain in extended in the first and/or second extended position/s during transit.

The first extended position may be intermediate the retracted and second extended positions.

The second extended position may correspond to a maximum diameter. The retracted position may correspond to a minimum diameter. The first extended position may correspond to an intermediate diameter.

The retracted and/or first extended and/or second extended position/s may be predetermined. The retracted and/or first extended and/or second extended position/s may be determined prior to running in the under-reamer. The retracted and/or first extended and/or second extended position/s may be selectable. For example, the retracted and/or first extended and/or second extended position/s may be selectable at surface, prior to running-in the under-reamer. The retracted and/or first extended and/or second extended position/s may be selectable according to a particular application. For example, the first extended diameter may be selected to provide clearance for a particular tool or casing or the like to be run-in subsequent to reaming. The first extended diameter may be selected according to a diameter of a previously lined or cemented section. The first extended diameter may be selected to ream inside or within run-in equipment or apparatus, such as previously run-in liner, casing, or the like.

The cutters may be moveable between the retracted and first extended positions and/or between the retracted and second extended positions and/or between the first extended and second extended positions by an activation member. The cutters may be moveable between the retracted and first extended positions and/or between the retracted and second extended positions and/or between the first extended and second extended positions by an axial movement of the activation member. The retracted position may correspond to a first axial position of the activation member. The first axial position may be an initial axial position, such as for during run-in. The first extended position may correspond to a second axial position of the activation member. The second extended position may correspond to a third axial position of the activation member. The first extended and second extended positions may be in the same axial direction, such as downhole (or uphole).

The second axial position of the activation member may be intermediate the first and third axial positions of the activation member. The first axial position of the activation member may correspond to a minimum travel or minimum stroke of the activation member, such as substantially no travel or stroke. The third axial position of the activation member may correspond to a maximum travel or full stroke of the activation member.

The under-reamer may be fluid actuated. The activation member may be fluid-actuated. The under-reamer/activation member may be fluid-actuated by fluid in the throughbore. The under-reamer/activation member may be actuated by fluid flowing through the throughbore, such as drilling fluid. The activation member may be axially moveable in response to a fluid actuation. The activation member may be movable in response to a fluid pressure differential acting across the activation member.

The activation member may comprise an activation piston. The cutters may be configured to be actuated by pressure acting across the piston. One side of the piston may be exposed to an internal body pressure and the other side of the piston may be exposed to an external body pressure (such as an annular pressure). Alternatively, or in addition, where fluid may be pumped through the body, one side of the piston may be exposed to an internal upstream pressure and the other side of the piston may be exposed to an internal downstream pressure. The piston may be annular.

The under-reamer may comprise a cam member. The cam member may be linked to the cutters and the activation member so as to translate an axial movement or force of the activation member to a transverse movement or force of the cutters, such as a radial movement or force. The cam member may be operatively associated with the activation member. The cam member may be axially fixed relative to the activation member. The activation member may comprise the cam member, or be attached to the cam member. The cam member may be axially moveable relative to the cutters.

The body may comprise a window or aperture to allow the radial movement of the cutters. The cutters may slide in and out of the window or aperture in the body in response to an axial movement of the activation member.

The under-reamer may be configured to selectively axially support the activation member at the first, second and/or third axial position/s. The under-reamer may be configured to limit movement of the activation member in at least one axial direction at the first, second and/or third axial position/s.

The under-reamer may comprise a limiter to define the second axial position of the activation member, corresponding to the first extended position.

The limiter may comprise a mechanical stop.

The limiter may limit the travel of the activation member in a single direction, such as a first axial direction (e.g. downhole or uphole). For example, the limiter may substantially prevent movement of the activation member beyond the second axial position corresponding to the first extended position of the cutters. Limiting the travel in only a single direction may allow the support of the activation member to prevent (further) movement in the single direction, whilst permitting the movement of the activation in the opposite direction. For example, the limiter may prevent further movement of the activation from the first axial position (corresponding to the retracted position) beyond the second axial position (corresponding to the first extended position), whilst allowing selective movement of the activation member from the second axial position back to the first axial position. Accordingly, the cutters may be selectively returned from the first extended position to the retracted position. In alternative embodiments the limiter may limit the travel of the activation member in both the first and a second axial direction (e.g. both downhole and uphole).

The limiter may engage the activation member at the second axial position corresponding to the first extended position. The limiter may support the activation member at the second axial position to support the activation member at the second axial position. The limiter may support the activation member at the second axial position such that the cutters are supported at the first extended position by the activation member. The limiter may support the activation member at the first extended position to prevent movement of the activation member beyond the second axial position in the first axial direction. Optionally, the limiter may support the activation member at the first axial position.

The limiter may support the activation member at the first axial position during a reaming operation. The limiter may support the activation member at the second axial position up to a maximum force threshold. The maximum force threshold at the second axial position may be greater than a force generated across the limiter with the apparatus in a first configuration, such as a force generated by a fluid pressure differential with the apparatus in the first configuration. The first configuration may be an initial configuration. In the first configuration, the limiter may be configured to support the activation member against movement in the first axial direction where the activation member may be biased towards the first axial direction, such as by a fluid pressure differential.

The fluid pressure differential may correspond to a maximum anticipated fluid pressure differential, such as may be anticipated under full flow conditions. Accordingly, the under-reamer in the first configuration may permit full flow with the activation member supported by the limiter at the second axial position, such as for reaming at the first extended position with full flow of drilling fluid flowing through the through-bore.

Alternatively, the fluid pressure differential may correspond to a maximum permitted fluid pressure differential, which may be an intermediate fluid pressure differential below the maximum anticipated fluid pressure differential such as corresponding to full flow conditions. Accordingly, the under-reamer may be maintained in the first configuration by capping flow at an intermediate value.

In the first configuration, the activation member may be moved from the first axial position to the second axial position by the force generated by the fluid pressure differential. Accordingly, in the first configuration, the cutters may be selectively moved between the retracted and first extended positions, such as by controlling fluid flow and/or pressure in the through-bore.

The limiter may be fixed relative to the body in the first configuration to define the second axial position of the activation member. The limiter may remain fixed to the body up to the maximum force threshold. The limiter may be releasably fixed relative to the body. The limiter may be selectively released to allow movement of the activation member beyond the second axial position by reconfiguring the under-reamer from the first configuration to a second configuration. For example, the limiter may be released when the maximum force threshold is exceeded, such as to allow movement of the activation member beyond the second axial position to the third axial position. The limiter may be releasably fixed relative to the body, such as fixed by shear pins, shear rings or the like.

In alternative embodiments, the limiter may be movable relative to the body. The limiter may be movable relative to the body directly in response to fluid conditions, such as fluid pressure differential. For example, the limiter may be, or may be operatively associated with, an indexing mechanism. The indexing mechanism may define the limiter at the second axial position according to a first indexing position. The indexing mechanism may support the limiter at the second axial position when the under-reamer is in the first configuration. The indexing mechanism may be indexed from the first indexing position corresponding to the first under-reamer configuration (with the activation member supported or supportable at the second axial position) to the second under-reamer configuration (with the activation member permitted to travel beyond the second axial position, such as to the third axial position) by indexing the indexing mechanism to a second indexing position.

The indexing mechanism may comprise a J-slot, defining a rotational and axial path of the indexing mechanism (e.g. in a clockwise or a counter-clockwise direction). The limiter may be associated with the indexing mechanism such that at least the axial movement of the indexing mechanism corresponds to an axial movement of the limiter. The indexing mechanism may comprise a continuous slot, for example to allow continuous cycling between configurations of the under-reamer. Alternatively, the indexing mechanism may define a finite slot, such as to provide a definite end position of the indexing mechanism and associated limiter.

The indexing mechanism may be generally similar to the indexer of applicant's WO2010/116152 applicant's International patent application, Publication No. WO2010/116152, the contents of which are incorporated herein by reference. A "long stroke" position may correspond to the third axial position of the activation member, a reset may correspond to the first axial position of the activation member and the "short stroke" may correspond to the second axial position if the activation member. The indexing mechanism may comprise additional axial positions in addition to the "long stroke", reset and "short stroke" sequence.

In response to a signal the under-reamer may be reconfigured from the first configuration (where the movement of the activation member in the first axial direction is limited at the second axial position by the limiter) to the second configuration (where movement of the activation member beyond the second axial position to the third axial position is allowed).

The signal may comprise a remote signal, such as from surface.

The signal may comprise one or more of: an actuation member; a fluid signal (e.g. a fluid pressure pulse, a flow rate sequence, or the like); and/or an optical or electrical signal; and/or a measurement signal (e.g. from a telemetry sub or other measurement apparatus, such as at surface or downhole).

The actuation member may be sent or dropped from surface, such as with a ball, dart, tag or the like, dropped or carried by fluid, such as within the through-bore. Additionally or alternatively, the actuation member may be sent or dropped remotely, such as downhole (e.g. from a downhole ball-dropper or the like).

The under-reamer may be reconfigured from the first configuration to the second configuration by providing for an increased fluid pressure differential. For example, an increased fluid pressure differential may be generated by providing a flow restriction or reducing a cross-sectional area of a flow restriction. For example, where the limiter is releasably fixed to the body in the first configuration, the under-reamer may be reconfigured to the second configuration by locating an actuation member, such as a drop-ball, downhole to provide for a flow restriction that results in a pressure differential that generates a force greater than the force threshold.

Additionally, or alternatively, an increased fluid pressure differential may be generated by increasing the flow rate above the capped intermediate value, if full flow is not permitted in the first configuration.

The first and/or second and/or third axial position/s may be predetermined. The first and/or second and/or third axial position/s may be predetermined according to selected properties of the activation member and/or the limiter and/or the cam member. For example, the first extended position of the cutters corresponding to the first reaming diameter may be predetermined by selecting the axial location of the limiter relative to the activation member and/or by selecting a corresponding offset provided by the cam member with the activation member positioned at that selected limit location. The axial location of the limiter may be selected to provide a predetermined clearance between the limiter and the activation member at the first axial position (corresponding to the retracted position) to allow a corresponding stroke or axial length of travel of the activation member from the first axial position to the second axial position. The cam member may be selected with a first slope, angle or profile to provide a first offset or radial extension of the cutters directly proportional to the stroke or axial length of travel of the activation member from the first to the second axial position.

The under-reamer may comprise a single limiter to define at least both the first and second extended positions (and may optionally comprise an additional limiter to define the retracted position). For example, where the limiter is releasably fixed relative to the body in the first configuration, the limiter may move relative to the body to allow engagement with the activation member at another axial location so as to define the third axial position of the activation member. Alternatively, where the limiter is, or is operatively associated with, an indexing mechanism, the second (or a third) indexing position may define the third axial position of the activation member.

Alternatively, the under-reamer may comprise a plurality of limiters to define the retracted and/or first extended and/or second extended position/s of the cutters. The plurality of limiters may limit the movement of the activation member between positions corresponding to the retracted and/or first extended and/or second extended positions. For example, the under-reamer may comprise at least a pair of limiters, each limiter of the pair defining the first extended position and the second extended position respectively.

The apparatus may comprise a plurality of mechanical stops. The apparatus may comprise a mechanical stop corresponding to each extended position. Optionally, the apparatus may comprise a mechanical stop corresponding to the retracted position. A first mechanical stop may correspond to the first extended position and a second mechanical stop may correspond to the second axial position of the activation member.

The second extended position of the cutters corresponding to the second reaming diameter may be predetermined by selecting the axial location of the limiter relative to the activation member in the second configuration and/or by selecting a corresponding offset provided by the cam member at that second location. Alternatively, where the under-reamer comprises a second limiter to define the third axial position of the activation member, the second extended position of the cutters may be predetermined by selecting the axial location of the second limiter relative to the activation member and/or by selecting a corresponding offset provided by the cam member with the activation member positioned at that selected second limit location. The axial location of the second limiter may be selected to provide a predetermined clearance between the second limiter and the activation member at the second axial position (corresponding to the retracted position) to allow a corresponding stroke or axial length of travel of the activation member from the second axial position to the third axial position. The cam member may be selected with a second slope, angle or profile to provide a second offset or radial extension of the cutters directly proportional to the stroke or axial length of travel of the activation member from the second to the third axial position. Preferably, the second slope, angle or profile of the cam member is the same as the first slope, angle or profile. Alternatively, the second slope, angle or profile of the cam member may be different to the first slope, angle or profile.

The axial location/s of the limiter/s and/or the cam member may be varied between downhole operations to provide different reaming diameters for different operations.

The axial location/s of the limiter/s and/or the cam member may be varied at surface, such as at rigsite.

The limiter may comprise one or more of: a landing profile, an abutment, a shoulder, a mandrel, a sleeve, a flange, a no-go or the like.

The under-reamer may be adapted to prevent reconfiguration from the second configuration to the first configuration. For example, the reconfiguration of the under-reamer from the first configuration to the second configuration may be a one-way process, such as where shear pins or the like are sheared during reconfiguration. Accordingly the under-reamer may be prevented from retracting the cutters from the second extended position to be subsequently supported at the first extended position. Preventing the under-reamer being returned to the first configuration may assist in ensuring that the cutters can be retracted from the second extended position to the retracted position, such as without the possibility that the cutters are retracted from the second extended position to only the first extended position. Ensuring that the cutters are retracted from the second extended position to the retracted position may be helpful when transiting the under-reamer through restrictions, such as when pulling the under-reamer from the hole.

In alternative embodiments, the under-reamer may be reconfigurable between the first configuration and the second configuration. For example, the indexing mechanism may be cycled between the configurations according to the indexing position, which may be controlled by fluid actuation.

The under-reamer may comprise a control mechanism such as described in Applicant's U.S. patent application Ser. No. 13/198,594, published as US2012031673 (A1); and/or applicant's International patent application, Publication No. WO2010/116152, the contents of each being incorporated herein by reference. The control mechanism may selectively effectively lock the activation member in the first axial position corresponding to the retracted position, or selectively effectively prevent locking in the first axial position thus allowing movement of the activation member between the first and/or second and/or third axial positions.

The under-reamer may be configurable to ream at more than two reaming diameters. For example, the cutters may be extendable to a third extended and optionally a fourth extended position/s, the third extended position corresponding to a third reaming diameter (and the fourth extended position corresponding to a fourth reaming diameter).

According to a further aspect of the present invention, there is provided a method of under-reaming comprising:

running an under-reaming tool comprising a plurality of extendable cutters into a bore;

extending the cutters from a retracted position to a first extended position;

reaming a first section of bore at a first diameter corresponding to the first extended position of the cutters;

extending the cutters to a second extended position;

reaming a second section of bore at a second diameter corresponding to the second extended position of the cutters.

The method may comprise reaming at at least two diameters with a single under-reamer. The method may comprise reaming at at least two diameters with a single under-reamer in a single run. Reaming at two diameters with a single under-reamer in a single run may save valuable time between trips in/out of hole with multiple under-reamers to ream at different diameters. The ability to selectively ream at different diameters may provide flexibility downhole. For example, where a tool may become stuck or experience resistance during transit downhole (e.g. due to a collapsed cement sheath), the under-reamer may selectively ream at a first (lesser) diameter to allow the further transit of the under-reamer to a subsequent downhole location for under-reaming at a second (greater) diameter.

The method may comprise reaming at at least two diameters with the same cutters in a single run.

The method may comprise extending the cutters to the second extended position from the retracted position.

The method may comprise extending the cutters to the second extended position from the first extended position.

According to a further aspect of the present invention there is provided an underreamer comprising a body, a plurality of cutters mounted on the body. The apparatus may be reconfigurable between a first configuration in which the cutters are retracted and a second configuration in which the cutters are extended at a first reaming diameter, and a third configuration at which the cutters are extended at a second reaming diameter, the first and second reaming diameters being different.

According to a further aspect of the present invention, there is provided a downhole toolstring comprising the apparatus, such as the under-reamer or portion/s thereof, of any other aspect/s.

The downhole toolstring may comprise one or more tools selected from: a packer; an anchor; a whipstock; a sidetracking tool; a coring tool; a downhole motor, such as a positive displacement motor; a reamer; a drillbit; a running tool; a MWD tool.

The invention includes one or more corresponding aspects, embodiments or features in isolation or in various combinations whether or not specifically stated (including claimed) in that combination or in isolation. For example, it will readily be appreciated that features recited as optional with respect to the first aspect may be additionally applicable with respect to any of the other aspects, without the need to explicitly and unnecessarily list those various combinations and permutations here. For example, features recited with respect to cutters of one aspect may be applicable to the cutters of another aspect, and vice-versa. Similarly the features recited in respect of any apparatus aspect may be similarly applicable to a method aspect, and vice-versa. For example, the apparatus may be configured to perform any of the functions or steps of a method aspect; and/or a method aspect may comprise any/all of the functions or steps associated with an apparatus aspect.

In addition, corresponding means for performing one or more of the discussed functions are also within the present disclosure.

It will be appreciated that one or more embodiments/aspects may be useful in under-reaming. In particular it will be appreciated that one or more embodiments/aspects may be useful in under-reaming at a plurality of diameters or gauges, such as to save time between reaming operations and/or to provide downhole flexibility.

The above summary is intended to be merely exemplary and non-limiting.

As used herein, the term "comprise" is intended to include at least: "consist of"; "consist essentially of"; "include"; and "be". For example, it will be appreciated that where the activation member may "comprise an activation piston", the controller may "include an activation piston" (and optionally other element/s); the activation member "may be an activation piston"; or the activation member may "consist of an activation piston"; etc. For brevity and clarity not all of the permutations of each recitation of "comprise" have been specifically stated. Similarly, as used herein, it will be appreciated that "downhole" and "uphole" do not necessarily relate to vertical directions or arrangements, such as when applied in deviated, non-vertical or horizontal bores.

BRIEF DESCRIPTION OF THE DRAWINGS

These and other aspects of the present invention will now be described, by way of example, with reference to the accompanying drawings, in which.

DETAILED DESCRIPTION OF THE DRAWINGS

Figure 1:
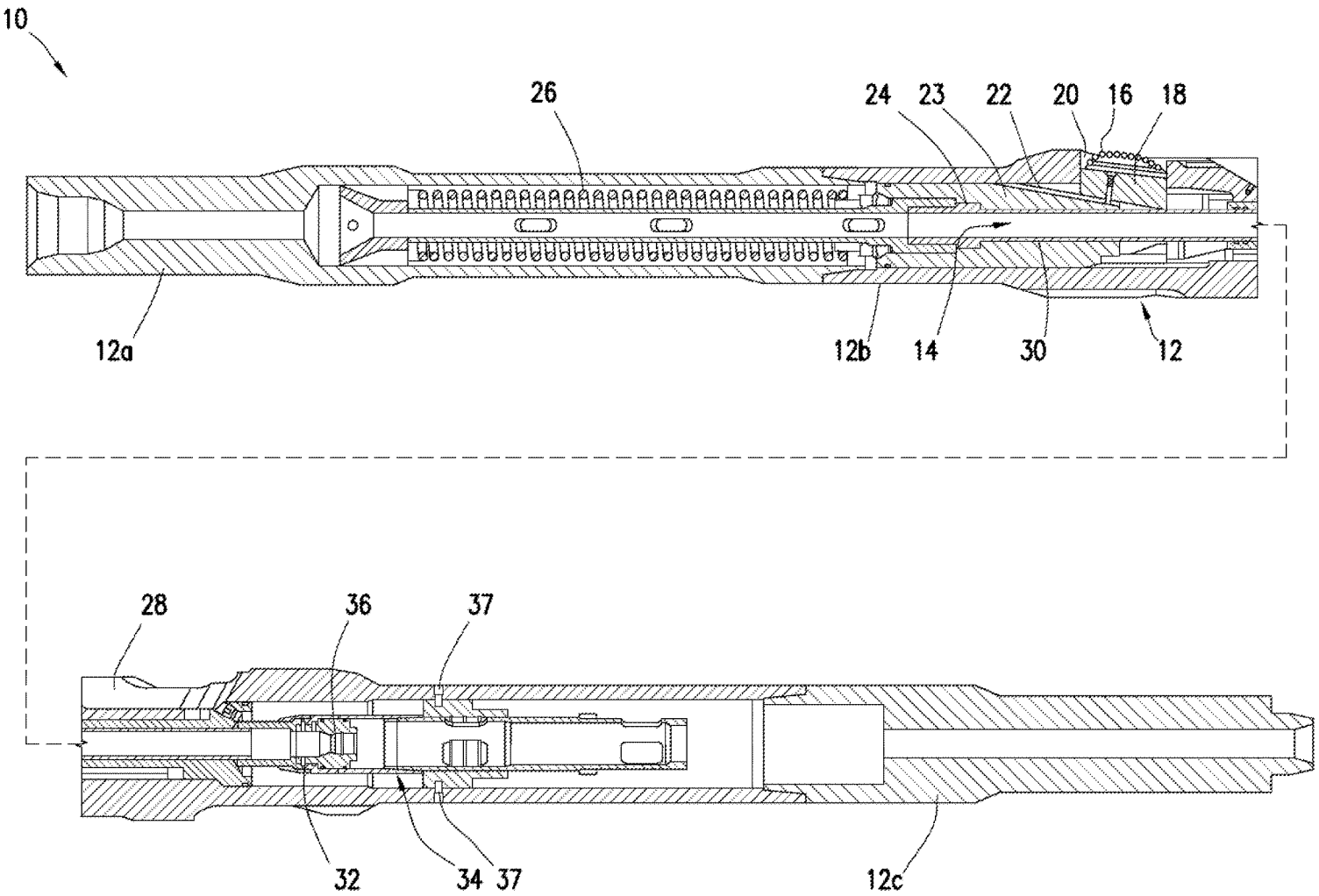
FIG. 1 is a schematic sectional view of a portion of a toolstring comprising an embodiment of an under-reamer according to the invention incorporated in a portion of a tool string.

Reference is first made to FIG. 1 of the drawings which is a sectional view of an under-reamer 10 in accordance with a preferred embodiment of the present invention. The under-reamer 10 is intended for location in a drill string or bottom hole assembly (BHA) with a drill bit (not shown) being provided on the distal end of the string below the under-reamer (to the right in the Figure). Accordingly, the under-reamer 10 comprises a tubular body 12 defining a through bore 14 so that fluid may be pumped from surface, through the string incorporating the under-reamer 10, to the drill bit, the fluid then passing back to surface through the annulus between the drill string and the surrounding bore wall.

The body 12 comprises a number or body sections 12*a*, 12*b*, 12*c* which are coupled to one another using conventional threaded couplings.

Figure 2:
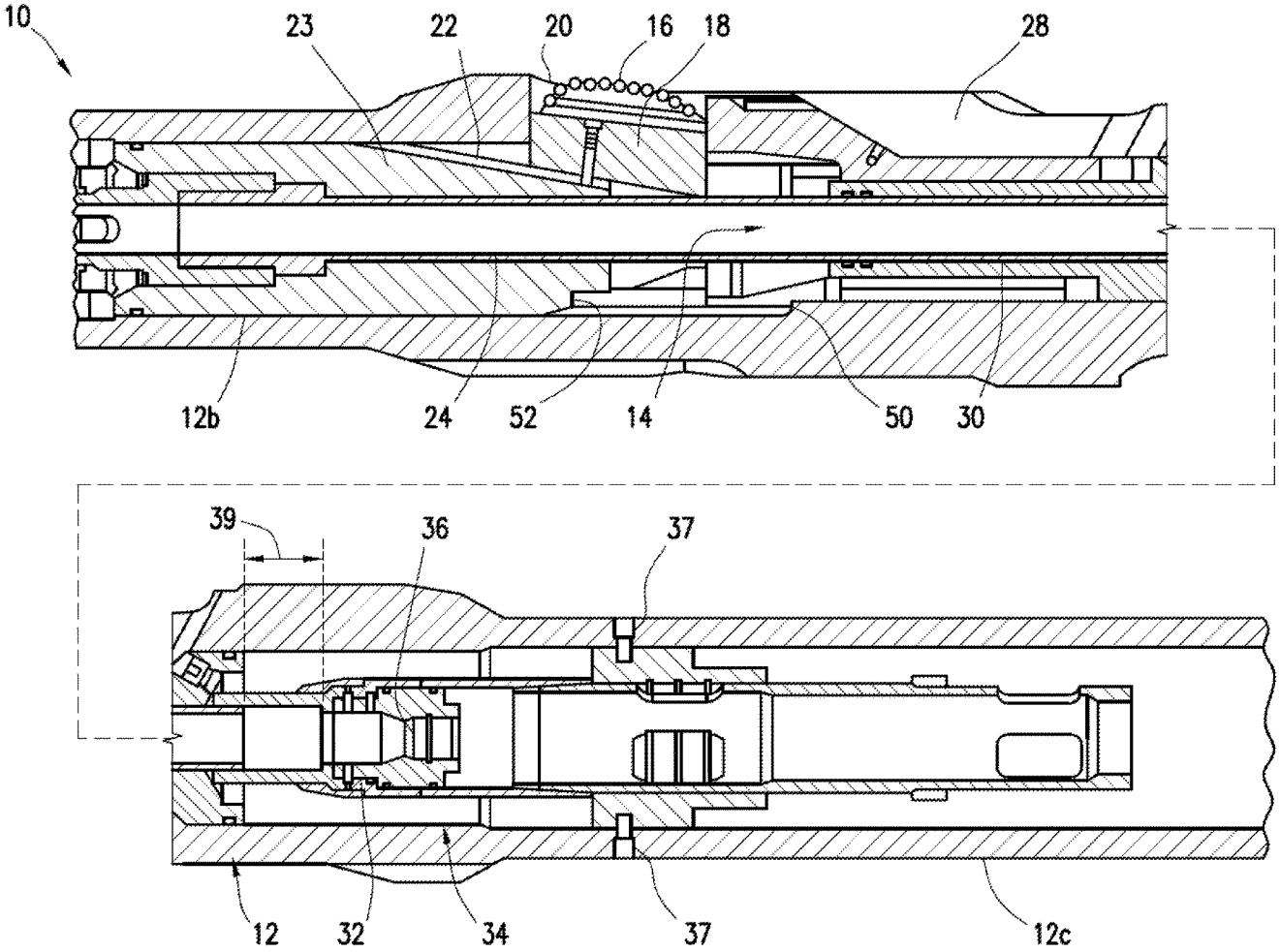
FIG. 2 is a detail view of a portion of the under-reamer of FIG. 1 with cutters retracted.

The under-reamer 10 features three extendable cutters 16 (only one shown in the drawings). As will be described, when the under-reamer 10 is in a first configuration, the cutters 16 may be selectively maintained in a first, retracted position, as illustrated in FIGS. 1 and 2, or the cutters 16 may selectively move to a first extended, cutting position (for example, see FIG. 3).

The cutters 16 are formed on cutter blocks 18 located in windows 20 of corresponding shape in the wall of the body 12. Each cutter block 18 features an inclined cam face 22 which co-operates with a surface of a cam member 23 associated with an activation member in the form here of an activation piston 24. The activation piston 24 is normally urged to assume the position as illustrated in FIG. 1, with the cutters 16 retracted, by a spring 26. However, when the internal fluid pressure within the under-reamer 10 exceeds the annulus pressure by a sufficient degree, the activation piston 24 may translate axially down through the body 12 to extend the cutters 16.

The lower face of the cutter windows 20 are formed by a secondary cutter retraction assembly 28 which is normally fixed in position. However, if sufficient downward force is applied to the assembly 28, via the cutters 16, the assembly 28 may move downwards independently of the activation piston 24, allowing the cutters 16 to retract even when the activation piston 24 jams in the cutter-extending position. Further details of the retraction assembly 28 are described in United States Patent Application Publication No. US2007/0089912 A1, the disclosure of which is as incorporated herewith in its entirety.

The activation piston 24 includes a tubular element 30 which extends through the secondary cutter retraction assembly 28. In the position as illustrated in FIG. 1, a lower face of the element 30 is spaced from an upper face of a tubular element 32 which forms part of a limiter 34. The tubular element 32 includes a ball-landing valve 36. In the embodiment shown, the limiter 34 is fixed to the body 12 by shear pins 37 in the position shown in FIG. 1.

In operation, the under-reamer 10 is set up as shown in FIGS. 1 and 2, following tripping in hole. As described above, the under-reamer 10 will be incorporated in a BHA above the drill bit. It will be appreciated that, although not shown, in other embodiments the under-reamer 10 may be locked in the position of FIGS. 1 and 2 for running-in, such as with a locking mechanism as described in Applicant's U.S. patent application Ser. No. 13/198,594, published as US2012031673 (A1) or and/or applicant's International patent application, Publication No. WO2010/116152.

Once the drill string has been made up to the appropriate depth drilling fluid will be circulated through the drill string. This results in the internal pressure rising above the external, annulus pressure.

Figure 3:
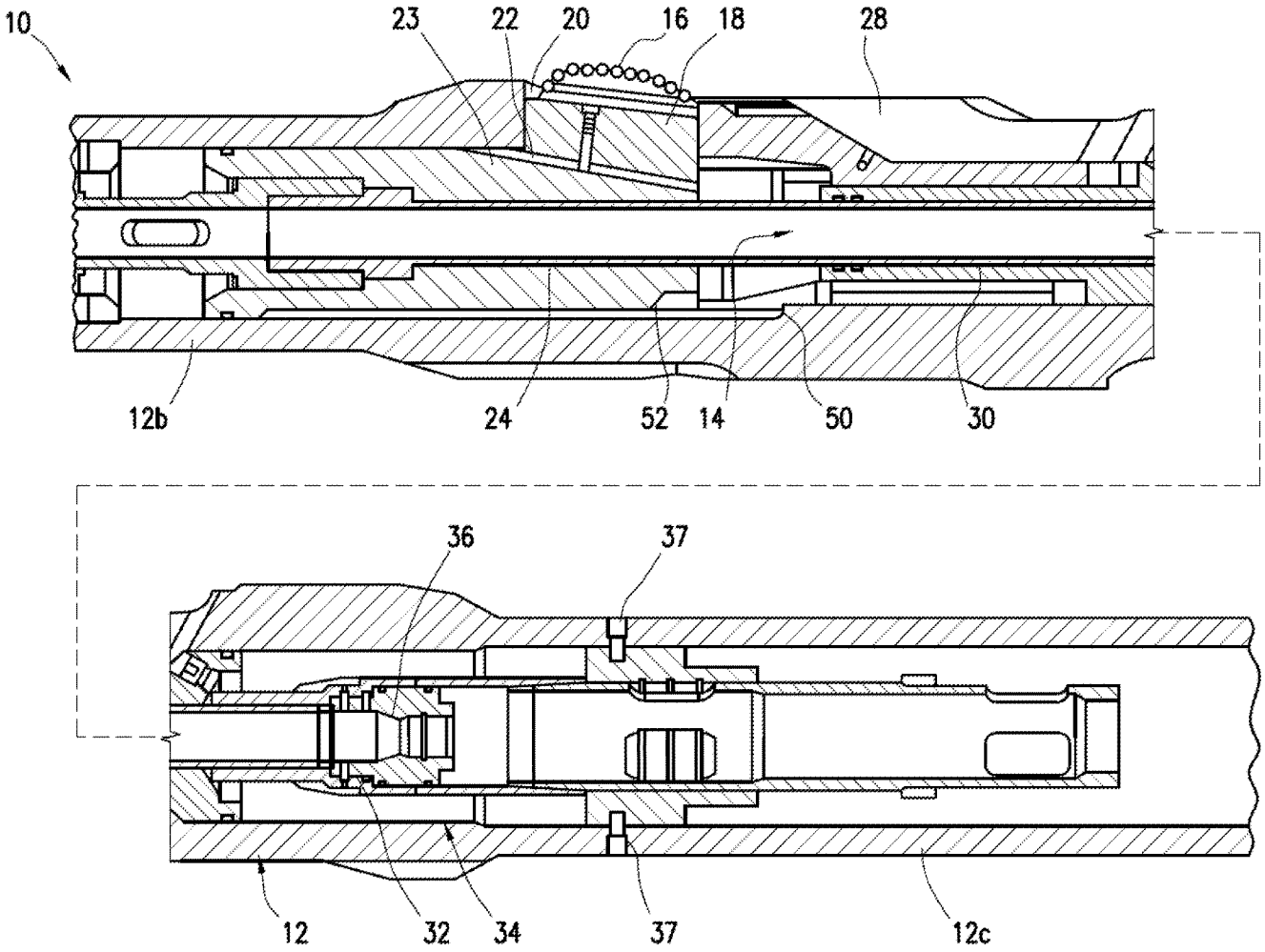
FIG. 3 is a detail view of a portion of the under-reamer of FIG. 1 with cutters at a first extended position.

With the under-reamer 10 in the configuration of FIG. 1, once the internal pressure rises sufficiently to reach a pressure differential with the external, annulus pressure, the force of the return spring 26 is overcome by the pressure differential such that the activation piston 24 moves downhole to the position of FIG. 3 with the cutters 16 moving from the retracted position to the first extended position.

The distance that the activation piston 24 travels downhole from the first axial position of FIGS. 1 and 2 to the second axial position of FIG. 3 is determined by an initial clearance 39 between the upper face of the tubular element 32 of the limiter 34 and the lower face of the activation piston 24. The corresponding relative radial extension of the cutters 16 between the positions of FIGS. 2 and 3 is directly proportional to the clearance 39 as translated by the angle of inclination of the inclined cam face 22 that co-operates with the corresponding inclined surface of the cam member 23. It will be appreciated that for other downhole operations, the angle of inclination may be varied or preferably the axial clearance 39 between the limiter 34 and the activation piston 24, such as by axially relocating the limiter 34 (e.g. by using holes for the shear pins 37 in the limiter 34 at a different position relative to the upper face).

The shear pins 37 are configured to accommodate forces transmitted between the limiter 34 and the body 12 resulting from the fluid pressure differential with the apparatus in the configuration of FIG. 3. Fluid can continue to be pumped through the through-bore 14, with the activation piston 24 pressed against the upper surface of the lower tubular member 32 by the force generated by the fluid pressure differential (minus the return spring 26 force). In the embodiment shown, the under-reamer 10 can be operated with the activation piston 24 at the position of FIG. 3 with the pumps fully on, allowing reaming at the first extended position of FIG. 3 with full fluid flow.

Accordingly, the under-reamer 10 can ream at a first diameter corresponding to the first extended position of the cutters 16. For example, the under-reamer 10 can be used to ream a cement sheath to allow the passage of the toolstring to a lower downhole location, such as for subsequent drilling and/or under-reaming.

When it is desired to stop reaming at the first diameter or to retract the cutters 16, fluid flow is reduced to below the degree required to overcome the force of return spring 26, resulting in the activation piston 24 and cutters 16 being returned to the positions of FIGS. 1 and 2.

In the first configuration and with the cutters 16 in the retracted position of FIGS. 1 and 2, the toolstring with under-reamer 10 may be translated downhole, such as through a restriction or to another location downhole (e.g. for further drilling/reaming).

Figure 4:
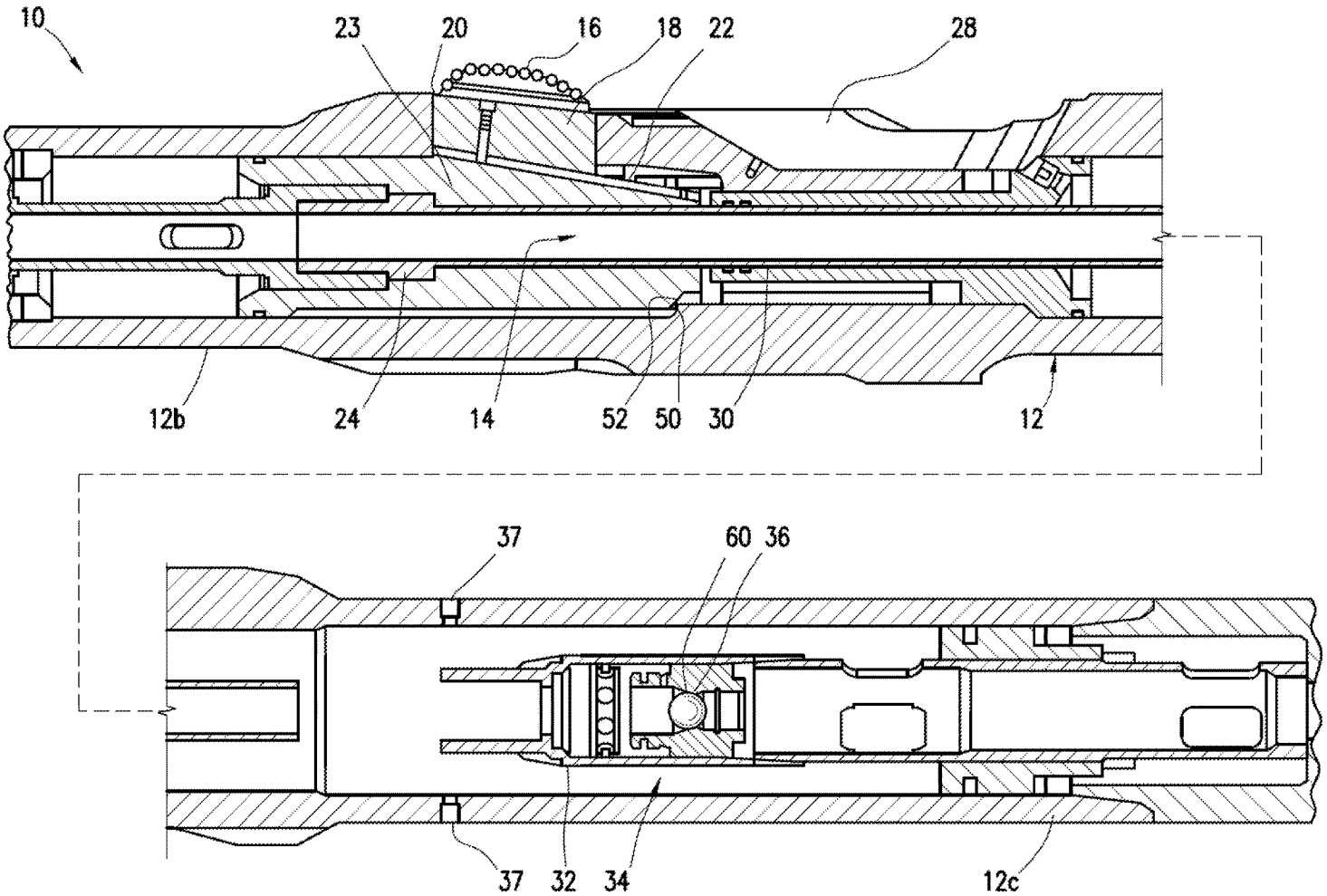
FIG. 4 is a detail view of a portion of the under-reamer of FIG. 1 with cutters at a second extended position.

When it is desired to ream at a second diameter, a drop-ball 60 is dropped to seat in the valve 36. The presence of the ball 60 in the valve 36 restricts fluid flow through the under-reamer 10 to the lower section of the string and causes an increased downwards force acting on the limiter 34 as a result of a fluid pressure differential between above the limiter 24 and below the limiter 24. This is assisted by the differential pressure acting on the activation piston 24 which experiences the higher fluid pressure acting above the ball 60. The resultant force on the limiter 34 is sufficient to overcome a threshold at which the shear pins 37 are sheared, allowing the limiter 34 to move downhole to the position of FIG. 4.

With the limiter 34 released from the position of FIGS. 1, 2 and 3, the limiter 34 no longer functions to restrict the activation piston 24 to the second axial position of FIG. 3. Accordingly, as for the extension of the cutters 16 for FIG. 3, provided the internal pressure is maintained sufficiently to reach a pressure differential with the external, annulus pressure, the force of the return spring 26 is overcome by the pressure differential such that the activation piston 24 now moves downhole to the position of FIG. 4 with the cutters 16 moving from the retracted position to the second extended position.

Accordingly, the under-reamer 10 can ream at a second diameter corresponding to the second extended position of the cutters 16. For example, the under-reamer 10 can be used to ream to a maximum gauge below a cement sheath or a casing, such as where a new section of bore is being drilled.

In the embodiment shown, the limiter 34 is moved sufficiently downhole that it can no longer engage the tubular element 30 of the activation piston 224. The third axial position of the activation piston 24 is defined by a second limiter in the form of a shoulder 50 associated with the body 12. The body shoulder 50 engages and supports the activation piston 24 at the third axial position through a corresponding shoulder 52 of the activation piston. It will be appreciated that in alternative embodiments, the passage downhole of the first limiter 34 may be restricted such that the first limiter may become supported by the body 12 so as to define the third axial position and support the activation piston 24 at the third axial position.

When it is desired to stop reaming at the second diameter or to retract the cutters 16, fluid flow is reduced to below the degree required to overcome the force of return spring 26, resulting in the activation piston 24 and cutters 16 being returned to the positions of FIGS. 1 and 2. Subsequent downhole movement of the activation piston 24 of the embodiment shown in FIGS. 1-4 after shearing of the shear pins 37 always results in the cutters 16 being extended to the second extended position, with no facility for the limiter 34 to return to the position of FIGS. 1, 2 and 3 to support the activation piston 24 at the second axial position of FIG. 3.

Figure 5:
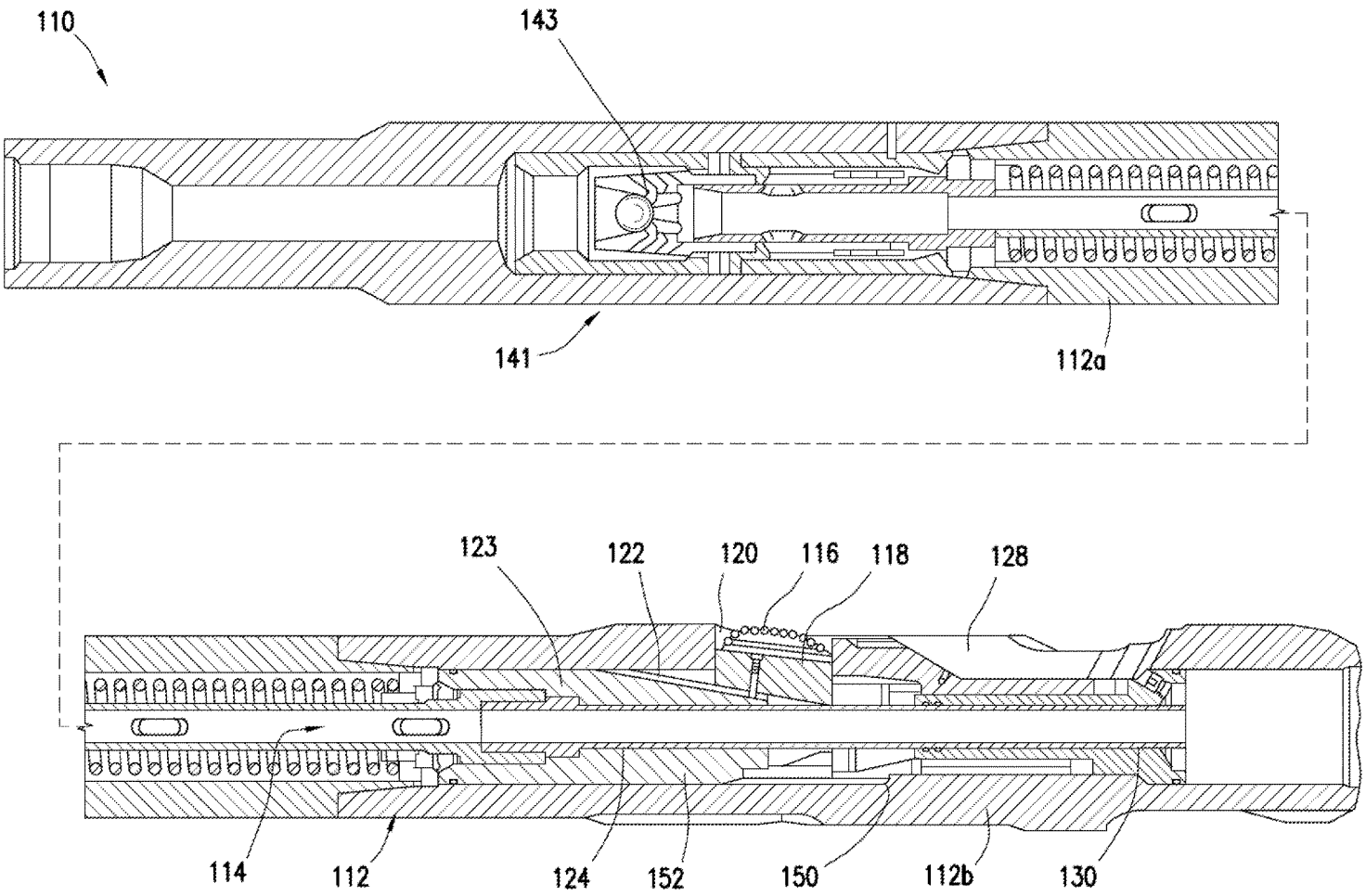
FIG. 5 shows a portion of an under-reamer according to a further embodiment of the present invention.

Referring now to FIG. 5, there is shown another embodiment of an under-reamer 110 in accordance with the present invention, with a limiter removed for clarity. It will be appreciated that a limiter 34 similar to that of FIGS. 1 to 4 may be included downhole of the activation piston 124. It will also be appreciated that the under-reamer 110 is generally similar to that shown in FIGS. 1 to 4, with corresponding features denoted by corresponding reference numerals incremented by 100. For example, the under-reamer 110 comprises three cutters 116 (only one of which is shown) generally similar to the cutters 16 of FIGS. 1 to 4. The under-reamer 110 shown comprises an uphole locking mechanism 141 that may function similarly to that of applicant's U.S. patent application Ser. No. 13/198,594, published as U.S. Ser. No. 2012031673 (A1). It will be appreciated that the locking mechanism 141 may be utilised to run the under-reamer 110 downhole until it is desired to have the facility to extend the cutters 116 to a position corresponding to that of FIG. 3. When it is desired to unlock the under-reamer 110 to allow extension of the activation piston 124 to the first and/or second axial position/s, a ball is dropped to seat in a valve 143. As the valve seat 143 associated with the locking mechanism 141 is uphole of a valve seat (not shown) of a limiter (not shown), the locking mechanism valve seat 143 may be of a larger diameter and associated with a ball-catcher (not shown) to allow a subsequent passage of a smaller ball to the limiter valve seat when it is desired to allow extension of the cutters 116 to a second extended position. Location of the ball in the valve seat 143 allows an increase in pressure differential sufficient to unlock the under-reamer 110 by disengaging locking dogs that are forced over a sleeve. Thereafter the activation piston 124 is free to move axially in response to fluid actuation.

Reference is now made to FIGS. 6 to 10 which show another embodiment of an under-reamer 210 according to the present invention. The under-reamer 210 is generally similar to that shown in FIG. 5, with corresponding features denoted by corresponding reference numerals incremented by 100. For example, the under-reamer 210 comprises three cutters 216 (only one of which is shown) generally similar to the cutters 116 of FIG. 5 and to the cutters 16 of FIGS. 1 to 4.

The under-reamer 210 comprises a lower locking mechanism 234, which is generally similar to the limiter 34 of FIGS. 1 to 4. However, the lower locking mechanism 234 of FIGS. 6 to 10 is located such that there is no clearance between the limiter 234 and the activation piston 224, unlike the clearance 39 provided in FIG. 2. An upper surface of a tubular element 232 of the lower locking mechanism 234 and a lower surface of the tubular element 230 of the activation piston 224 abut and are engaged as can be seen in FIG. 11, which shows a detail view of a portion of the lower locking mechanism 234 of FIGS. 6 to 10. The lower locking mechanism 234 functions as a tripping-in lock, allowing the under-reamer 210 to be run downhole and fluid to be circulated without allowing any axial movement of the activation piston 224 that would extend the cutters 216.

Figure 6:
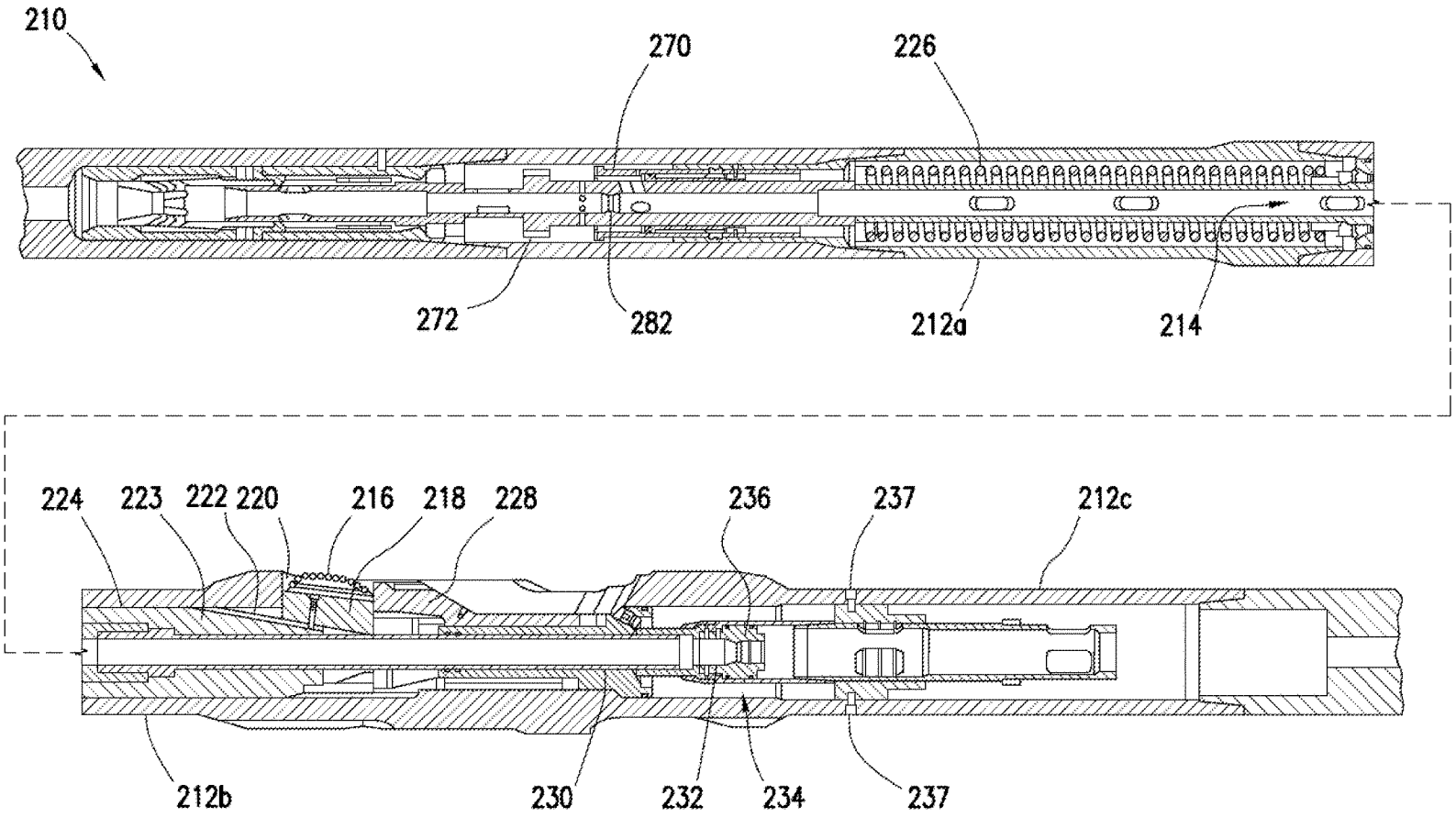
FIG. 6 shows a portion of a tool-string with an under-reamer according to a further embodiment of the present invention with cutters locked in a retracted position.
Figure 7:
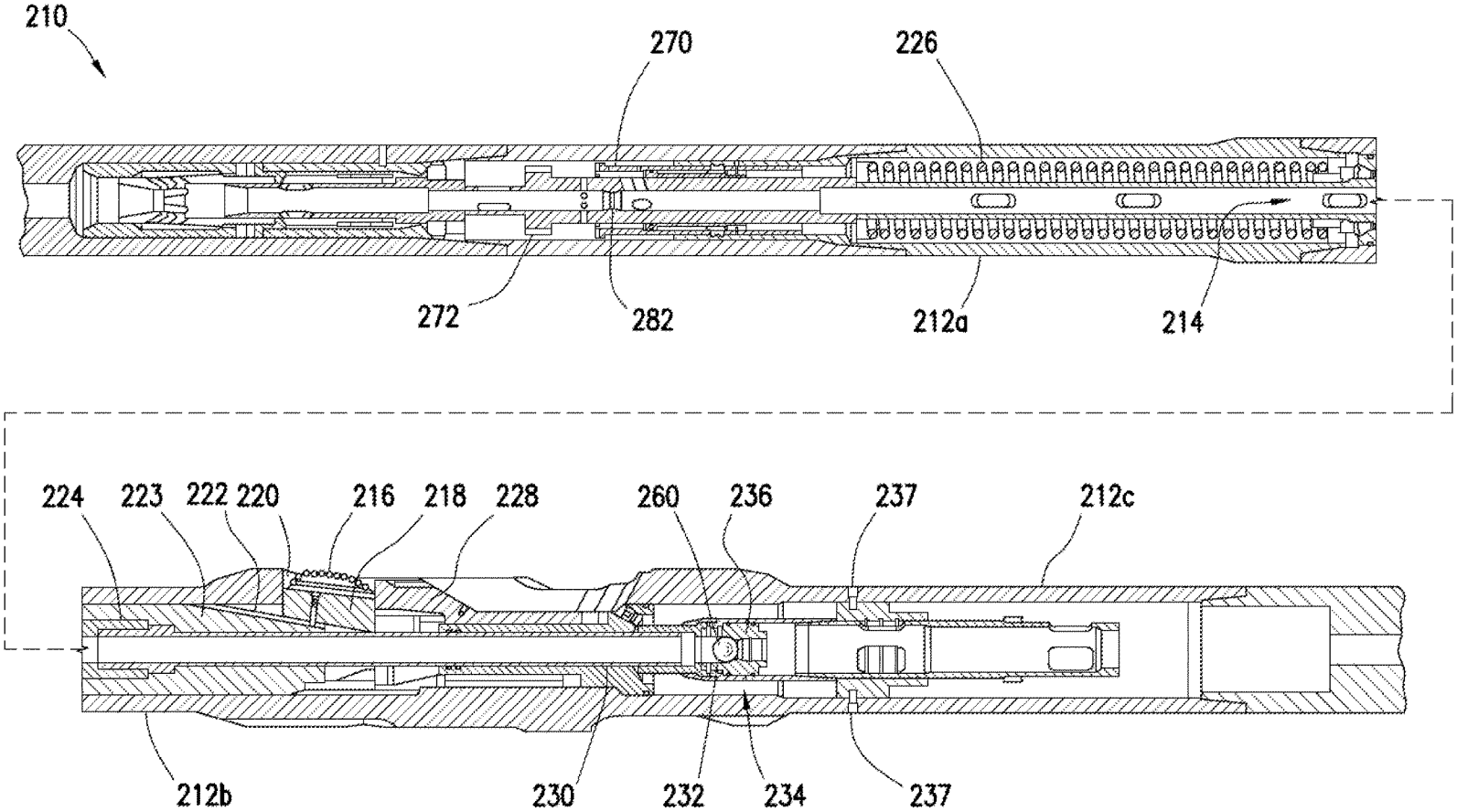
FIG. 7 shows the portion of tool-string of FIG. 6 with the under-reamer unlocked.
Figure 8:
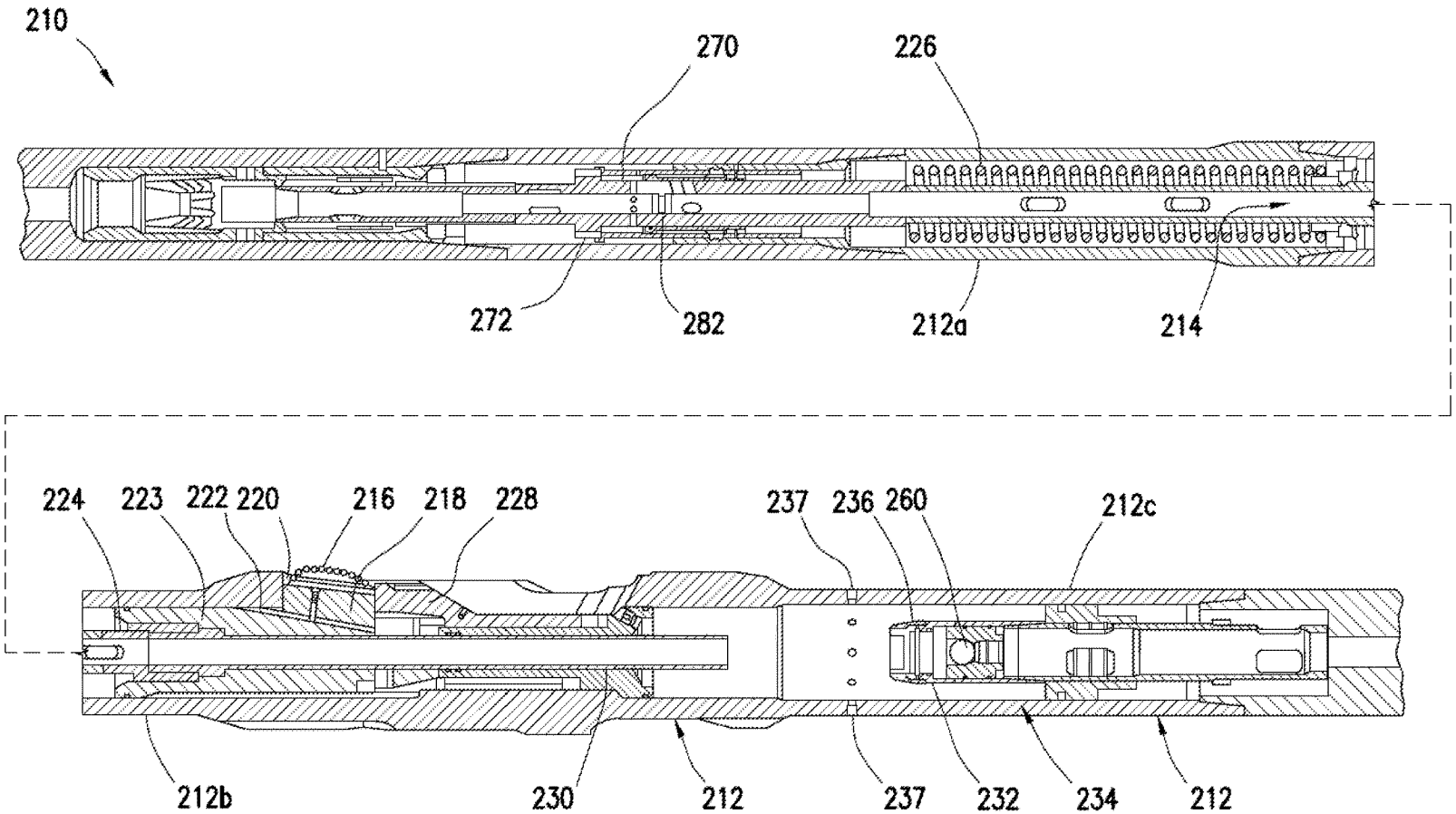
FIG. 8 shows the portion of the tool-string of FIG. 6 with cutters at a first extended position.
Figure 9:
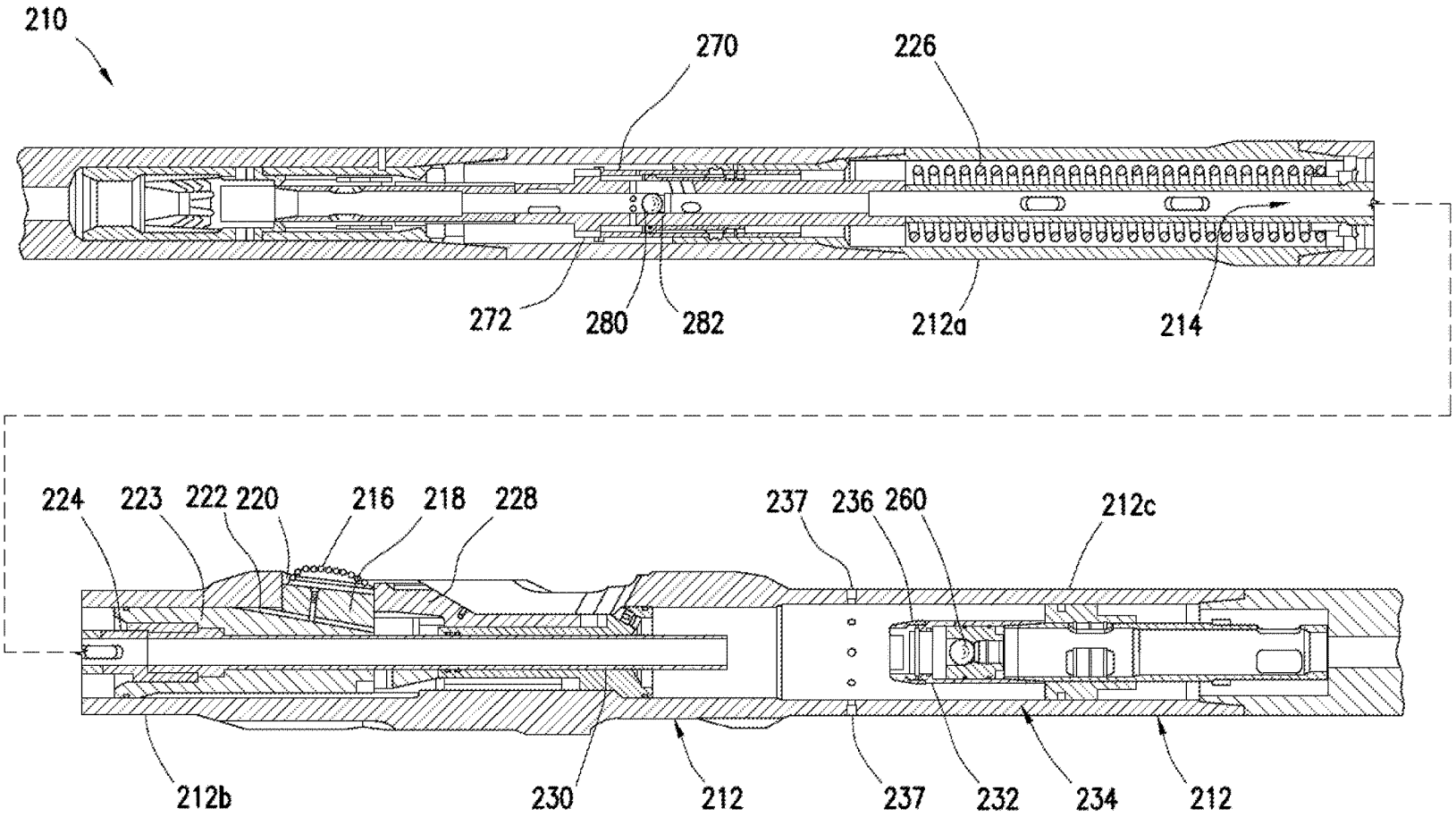
FIG. 9 shows the portion of the tool-string of FIG. 6 with cutters at the first extended position of FIG. 8 with a ball dropped.

When it is desired to initiate a reaming operation or to allow initiation of a reaming operation, a first ball 260 is dropped to seat in a valve 236 of the lower locking mechanism 234, as shown in FIG. 7. Similar to the transition of the limiter 34 from the position of FIG. 3 to FIG. 4, shear pins 237 are sheared resulting from an increased pressure differential caused by the restricted flow around the first ball 260 and the locking mechanism 234 is driven downhole as a piston to the position of FIG. 8. The activation piston 224 is now unlocked and is free to move axially downhole to the position of FIG. 8. When the internal pressure is maintained sufficiently, the activation piston 224 is driven downhole by the pressure differential between internal and external as shown in FIG. 8. The downhole axial position of the activation piston 224 is limited by a second limiter in the form of a mandrel 270 that engages a corresponding stop in the form of a flange 272 associated with the activation piston 224. It will be appreciated that the relative positions of the flange 272 and the mandrel 270 as shown in FIG. 11 correspond to the under-reamer 210 with the activation piston 224 in a retracted position, such as shown in FIGS. 6 and 7. A clearance 239 between the flange 272 and the mandrel 270 determines the travel of the activation piston 224 from the first axial position corresponding to the retracted position of FIGS. 6 and 7 to the first extended position of FIG. 8. The activation piston 224 is supported at the first axial position of FIG. 8 by the contact between the flange 272 and the mandrel 270. Accordingly, the under-reamer 210 can ream at the first extended diameter, shown in FIG. 8, with fluid flowing through the through-bore 214.

If it is desired to retract the cutters 216 from the intermediate reaming position of FIG. 8 to the retracted position of FIG. 7, fluid flow can be reduced such that the pressure differential is no longer sufficient to overcome a spring 226 force and the activation piston 224 is biased uphole towards the first axial position of FIG. 7.

If it is subsequently desired to extend the cutters 216 again to ream at the first extended position, fluid flow can be sufficiently increased again to overcome the spring force.

Figure 12:
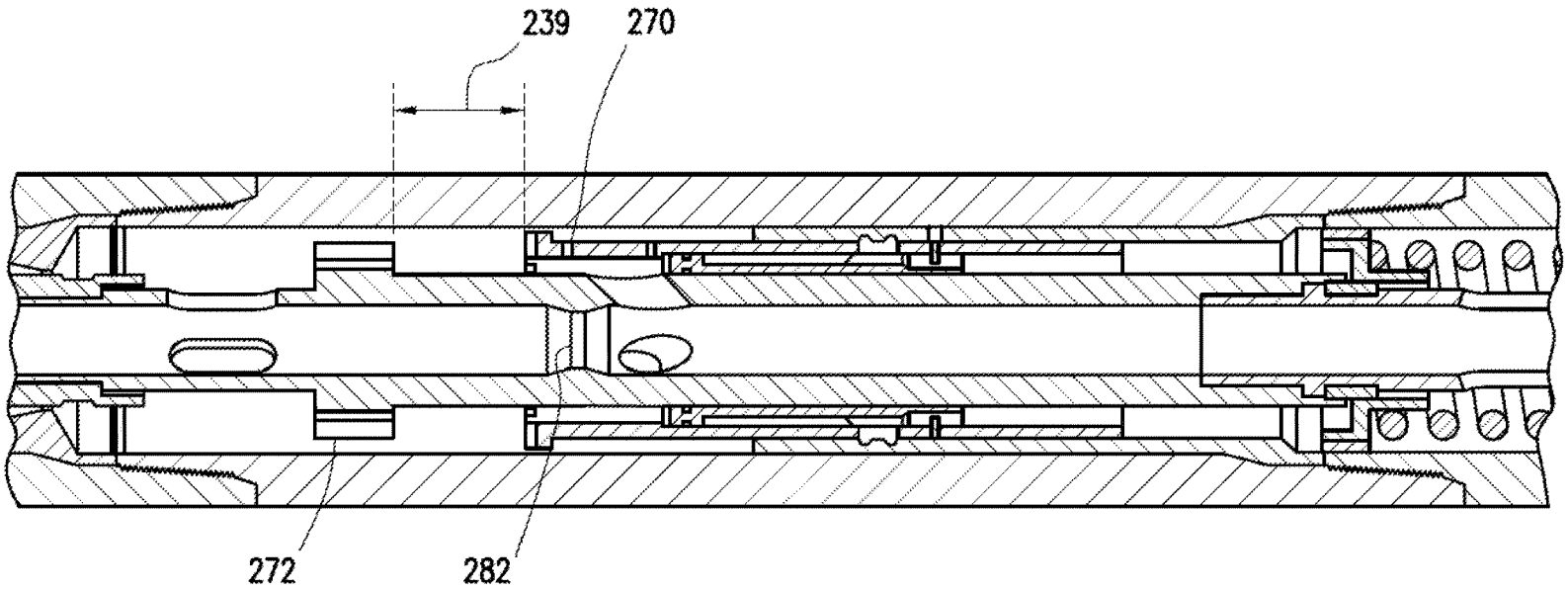
FIG. 12 shows a detail view of a limiter of the under-reamer of FIG. 6.

If it is subsequently desired to ream at an increased diameter, a second drop-ball 280 can be dropped to seat in a second valve 282, as shown in detail in FIG. 12. The second valve 282 is associated with the activation piston 224 and is of larger diameter than the valve seat 236 associated with the lower locking mechanism 234, to allow the first drop-ball to pass through the second valve 282 downhole to the first valve seat 236 to unlock the under-reamer as described above. The location of the second drop-ball 280 in the second valve 282 creates a flow restriction that causes an increased pressure differential to be generated across the activation piston 224. Accordingly fluid flow generates a greater downhole force by the activation piston 224 which can be sufficient to shear locking pins 284. Accordingly, the mandrel 270 can move downhole and the flange 272 no longer blocks the downhole movement of the activation piston 224 at the second axial position (corresponding to the first extended position of the cutters 216). The force generated by the fluid differential across the activation piston 224 forces the activation piston 224 further downhole to the third axial position of FIG. 10, where the cutters 216 are in the second extended position for reaming at a second diameter, the second diameter greater than the first. The third axial position is determined by a mechanical stop In the embodiment shown, the third axial position of the activation piston 224 is defined by a second limiter in the form of a shoulder 250 associated with the body 212. The body shoulder 250 engages and supports the activation piston 224 at the third axial position through a corresponding should 252 of the activation piston.

Figure 10:
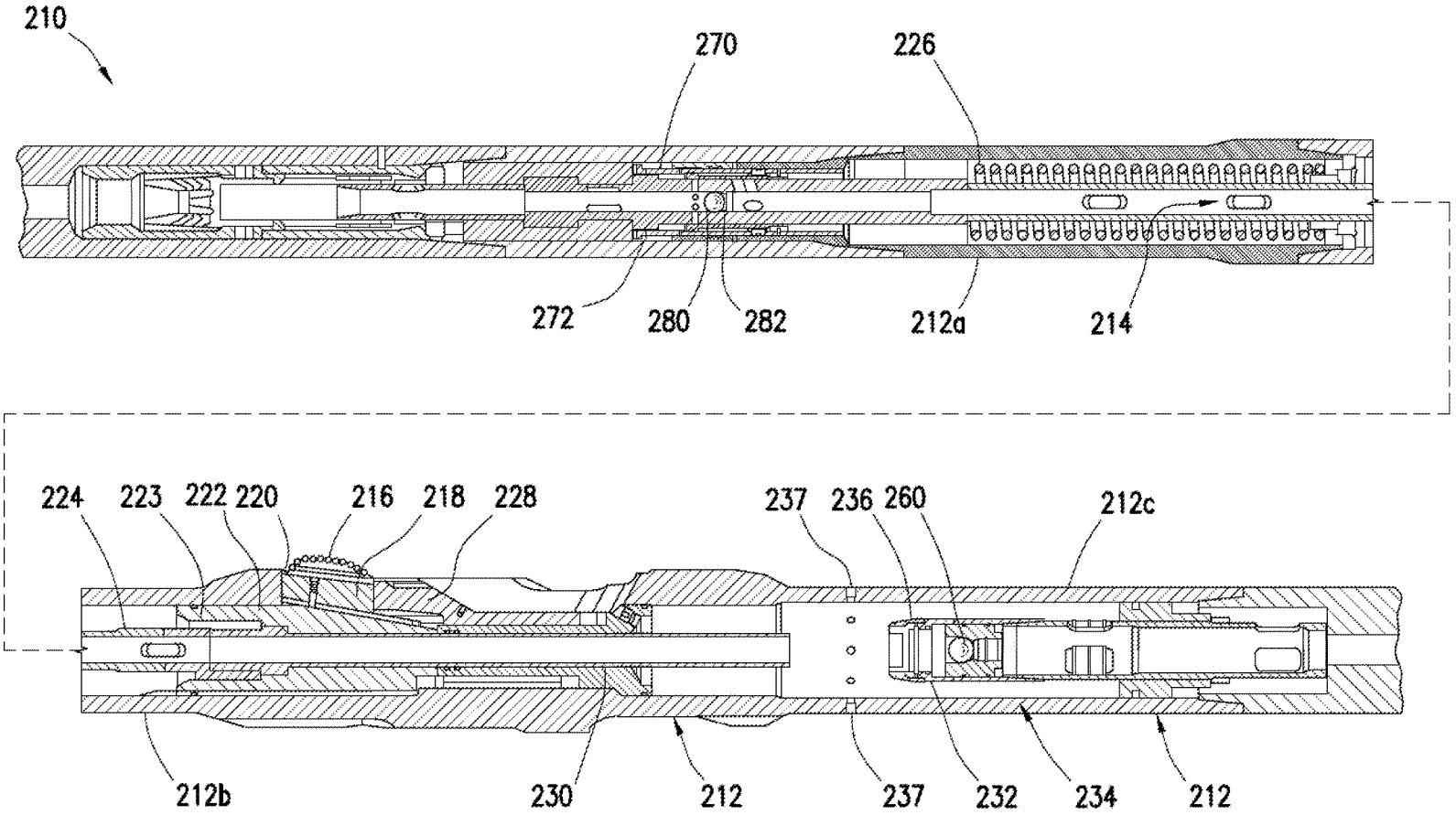
FIG. 10 shows the portion of the tool-string of FIG. 6 with cutters at a second extended position.
Figure 11:
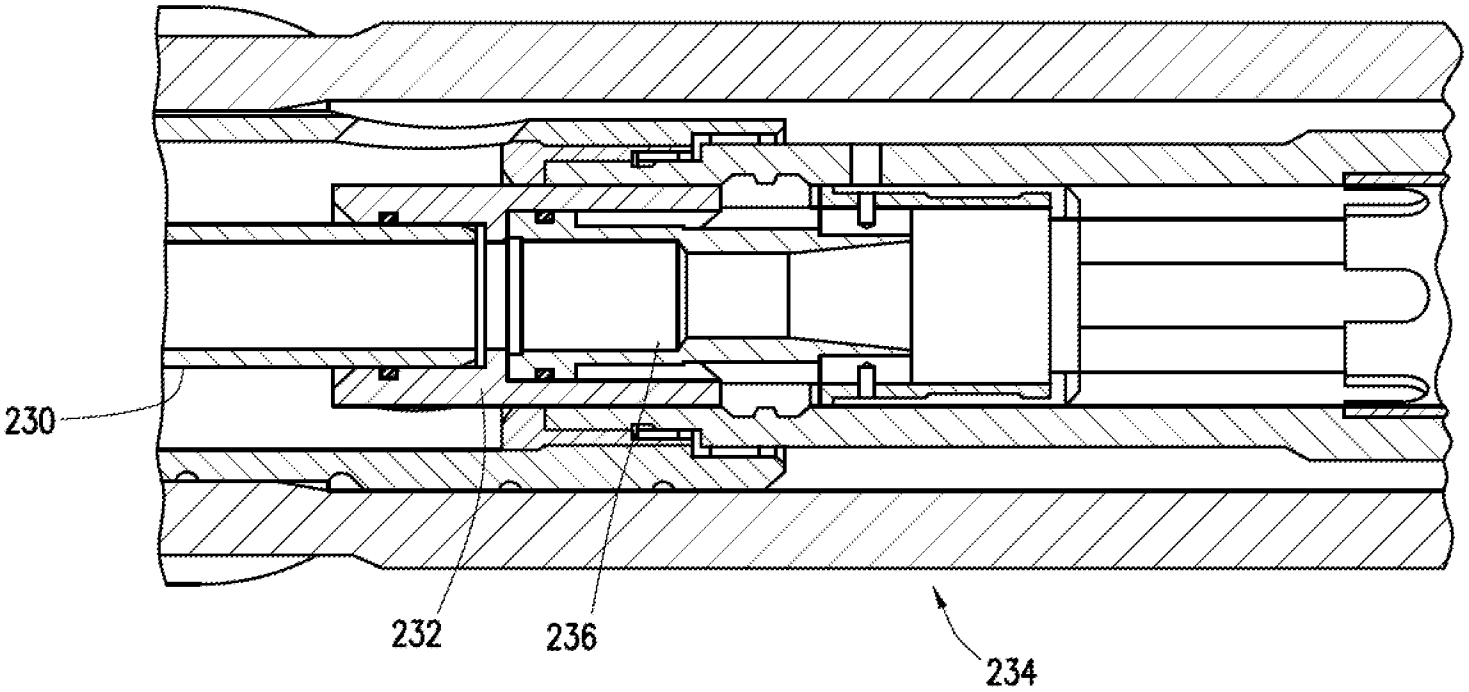
FIG. 11 shows a detail view of a locking portion of the under-reamer of FIG. 6.

If it is desired to retract the cutters 216 from the maximum reaming position of FIG. 10 to the retracted position of FIG. 7, fluid flow can be reduced such that the pressure differential is no longer sufficient to overcome a spring 226 force and the activation piston 224 is biased uphole towards the first axial position of FIG. 7.

If it is subsequently desired to extend the cutters 216 again to ream at the second extended position, fluid flow can be sufficiently increased again to overcome the spring 226 force.

Figure 13:
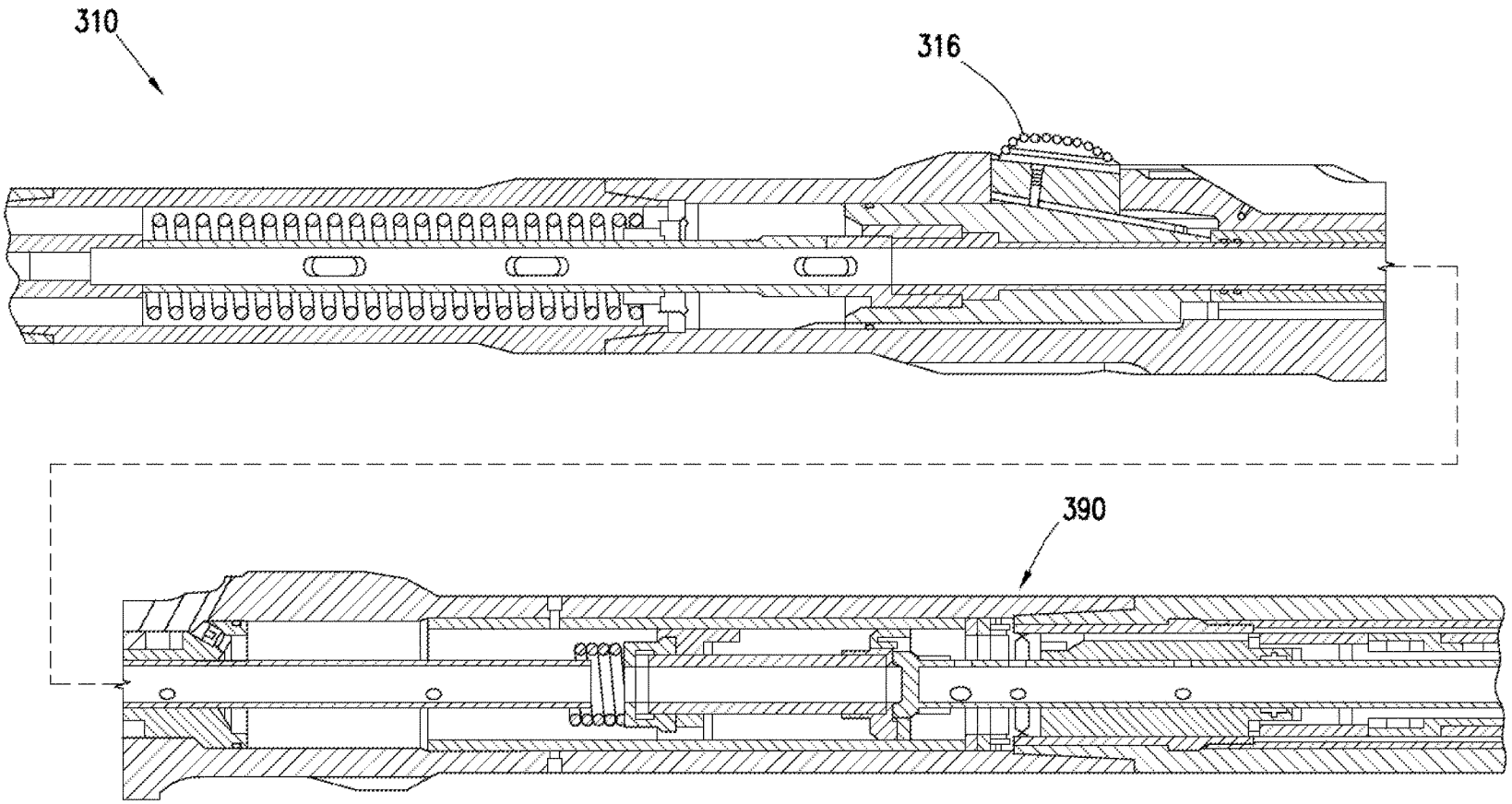
FIG. 13 shows an under-reamer according to a further embodiment of the present invention.

Reference is now made to FIG. 13 which shows an alternative embodiment of an under-reamer 310 in accordance with the present invention. The under-reamer 310 is generally similar to that shown in FIGS. 6 to 10, with corresponding features denoted by corresponding reference numerals incremented by 100. For example, the under-reamer 310 comprises three cutters 316 (only one of which is shown) generally similar to the cutters 216 of FIG. 6 and to the cutters 16 of FIGS. 1 to 4. It will be appreciated that the under-reamer 310 of FIG. 13 may include an uphole locking mechanism similar to that shown in FIG. 5.

The under-reamer 310 of FIG. 13 functions generally similarly to that of FIGS. 1 to 4. However, a tubular element 232 of the limiter 334 is associated with an indexing mechanism 390 with a J-slot. Accordingly a mechanical stop defined by the limiter is axially movable according to the indexed position of the indexing mechanism 390 relative to the body 312. When it is desired to ream at a first, intermediate diameter, the indexing mechanism 390 is indexed to an intermediate or "short stroke" indexing position. Accordingly, the axial movement of the activation piston 324 is limited downhole to the second axial position and the under-reamer 310 can ream at the first, intermediate diameter with the cutters in the first extended position. When it is desired to return the cutters to the retracted position, the indexing mechanism 390 can be indexed to a reset position. Subsequent indexing of the indexer can utilise a "long stroke" to move the tubular element 232 further downhole to define a third axial position for the activation piston 224. Accordingly, the maximum downhole extension of the activation piston 224 is defined by the indexing mechanism 390 according to the selected indexing position.

It will be apparent to those of skill in the art that the above described embodiments are merely exemplary of the present invention, and that various modifications and improvements may be made thereto, without departing from the scope of the invention. For example, where a drop-ball has been illustrated, other flowable objects may be used in other embodiments, such as plugs, darts or the like.

It will be appreciated that any of the aforementioned tools may have other functions in addition to the mentioned functions, and that these functions may be performed by the same tool.

Where features have been described as downhole or uphole; or proximal or distal with respect to each other, the skilled person will appreciate that such expressions may be interchanged where appropriate. For example, the skilled person will appreciate that where the activation member is activated to move downhole to extend the cutters in the embodiments shown; in an alternative embodiment, the activation member may be activated uphole to extend the cutters.

The applicant hereby discloses in isolation each individual feature described herein and any combination of two or more such features, to the extent that such features or combinations are capable of being carried out based on the present specification as a whole in the light of the common general knowledge of a person skilled in the art, irrespective of whether such features or combinations of features solve any problems disclosed herein, and without limitation to the scope of the claims. The applicant indicates that aspects of the present invention may consist of any such individual feature or combination of features. In view of the foregoing description it will be evident to a person skilled in the art that various modifications may be made within the scope of the invention.

The invention claimed is:

1. A downhole under-reamer for use in reaming a downhole bore, the under-reamer comprising a body and a plurality of cutters mounted on the body, wherein the cutters are mounted on the body so as to be extendable from a retracted position to at least two extended positions, the at least two extended positions comprising a first extended position and a second extended position corresponding to reaming positions at respective first and second reaming diameters such that the under-reamer is capable of reaming a bore to a plurality of gauges; wherein the cutters are formed on cutter blocks located in windows of corresponding shape in the wall of the body.

2. The downhole under-reamer of claim 1, wherein the under-reamer is configurable to ream at more than two reaming diameters, the cutters being extendable to at least a third extended position corresponding to a third reaming diameter.

3. The downhole under-reamer of claim 1, wherein the under-reamer is configurable to ream multiple passages or sections at similar or different diameters, with the multiple passages or sections comprising one or more of: contiguous passages or sections; and discontiguous passages or sections.

4. The downhole under-reamer of claim 1, wherein the cutters are moveable between the retracted and first extended positions and between the retracted and second extended positions and between the first extended and second extended positions by an axial movement of an activation member, the retracted position corresponding to a first axial position of the activation member, the first extended position corresponding to a second axial position of the activation member, and the second extended position corresponding to a third axial position of the activation member.

5. The downhole under-reamer of claim 4, wherein at least one of:

the activation member is fluid-actuated by fluid in the throughbore;

the activation member comprises an activation piston;

the under-reamer is configured to selectively axially support the activation member at one or more of: the first axial position, the second axial position, and the third axial position.

6. The downhole under-reamer of claim 4, wherein the under-reamer comprises a limiter to define the second axial position of the activation member, corresponding to the first extended position.

7. The downhole under-reamer of claim 6, wherein at least one of:

the limiter may limit the travel of the activation member in a single direction such that the limiter substantially prevents movement of the activation member in a first axial direction beyond the second axial position corresponding to the first extended position of the cutters;

the limiter prevents further movement of the activation beyond the second axial position corresponding to the first extended position, whilst allowing selective movement of the activation member from the second axial position back to the first axial position, such that the cutters are selectively returnable from the first extended position to the retracted position;

the limiter supports the activation member at the second axial position such that the cutters are supported at the first extended position by the activation member; and the limiter supports the activation member at the second axial position up to a maximum force threshold, the maximum force threshold at the second axial position being greater than a force generated across the limiter with the apparatus in a first configuration.

8. The downhole under-reamer of claim 6, wherein at least one of:

the limiter is fixed relative to the body in the first configuration to define the second axial position of the activation member;

the limiter remains fixed to the body up to the maximum force threshold, whereby the limiter is selectively released to allow movement of the activation member beyond the second axial position by reconfiguring the under-reamer from the first configuration to a second configuration when the maximum force threshold is exceeded, such as to allow movement of the activation member beyond the second axial position to the third axial position.

9. The downhole under-reamer claim 6, wherein the limiter is movable relative to the body directly in response to fluid conditions.

10. The downhole under-reamer of claim 9, wherein the limiter is operatively associated with an indexing mechanism, the indexing mechanism defining the limiter at the second axial position according to a first indexing position, and the indexing mechanism being indexable from the first indexing position corresponding to the first under-reamer configuration to a second under-reamer configuration, with the activation member permitted to travel beyond the second axial position to the third axial position, by indexing the indexing mechanism to a second indexing position.

11. The downhole under-reamer of claim 6, wherein in response to a signal the under-reamer is reconfigurable from the first configuration to the second configuration, the signal comprising a remote signal from the surface.

12. The downhole under-reamer of claim 6, wherein at least one of:

the axial location of the limiter is selected to provide a predetermined clearance between the limiter and the activation member at the first axial position, corresponding to the retracted position, to allow a corresponding stroke or axial length of travel of the activation member from the first axial position to the second axial position;

the axial location of the limiter and/or the cam member may be varied between downhole operations to provide different reaming diameters for different operations.

13. The downhole under-reamer of claim 6, wherein the under-reamer comprises a control mechanism for at least one of: selectively effectively locking the activation member in the first axial position corresponding to the retracted position; and selectively effectively preventing locking in the first axial position thus allowing movement of the activation member between the first and second axial positions.

14. A downhole toolstring comprising the downhole under-reamer of claim 1.

15. A method of under-reaming comprising:

running an under-reaming tool comprising a plurality of extendable cutters into a bore;

extending the cutters from a retracted position to a first extended position;

reaming a first section of bore at a first diameter corresponding to the first extended position of the cutters;

extending the cutters to a second extended position;

reaming a second section of bore at a second diameter corresponding to the second extended position of the cutters, wherein the cutters are formed on cutter blocks located in windows of corresponding shape in the wall of the body.

16. The method of claim 15, wherein at least one of:

the first section comprises a lined or cased section and the first extended position is selected to ream inside the liner or casing; and wherein the first section comprises one or more of: a previously-reamed section and a cement sheath.

17. The method of claim 15, wherein the method comprises at least one of: reaming at least two diameters with a single under-reamer according to claim 1.

18. The method of claim 15, wherein the method comprises reaming at least two diameters with the same cutters in a single run.

19. The method of claim 15, wherein the first and second sections are contiguous, or wherein the first and second sections are discontiguous.

20. The method of claim 15, wherein at least one of:

the method comprises reaming a single passage or section at successive or sequential diameters, such as at a first diameter during a first pass of the under-reamer and at a second diameter during a second pass of the under-reamer; and the method comprises retracting the cutters in between successive downhole reaming operations; and re-extending the cutters for the successive downhole reaming operation.

* * * * *